United States Patent [19]

Salzberg

[11] 4,217,565

[45] Aug. 12, 1980

[54] HYBRID T-JUNCTION SWITCH

[76] Inventor: Edward Salzberg, 19 Black Oak Rd., Wayland, Mass. 01778

[21] Appl. No.: 973,245

[22] Filed: Dec. 26, 1978

[51] Int. Cl.[2] ..... H01P 1/15

[52] U.S. Cl. ..... 333/258; 333/103; 333/122; 333/33

[58] Field of Search ..... 333/101, 103, 104, 121, 333/122, 164, 258

[56] References Cited

U.S. PATENT DOCUMENTS

| | | | |
|---|---|---|---|
| 2,934,658 | 4/1960 | Lewis | 333/122 X |
| 3,195,074 | 7/1965 | Rebsch | 333/103 |

*Primary Examiner*—Paul L. Gensler

*Attorney, Agent, or Firm*—Thomas N. Tarrant

[57] ABSTRACT

A microwave hybrid T-Junction switch using the two main (symmetrical) arms as input/output ports and two branch arms (E and H-plane) as control terminals, one of the branch arms containing a biased diode for switching and the other branch arm terminated with a fixed electrical short.

8 Claims, 10 Drawing Figures

HYBRID T-JUNCTION SWITCH

BACKGROUND OF THE INVENTION

1. Field of the Invention

The invention relates to microwave hybrid junctions as switches.

2. Description of the Prior Art

Microwave hybrid junctions are four terminal devices which ideally have the property that power supplied to a given terminal is divided usually equally between two of the remaining terminals with nothing reflected back or coupled to the fourth terminal. However, by appropriate positioning of short circuits in said two of the remaining terminals (control terminals), the energy provided to them can reflect to return to the input or add at the fourth terminal. A selectively forward or reverse biased diode can effect electrical movement of a short circuit location so as to switch the path from the given terminal to the fourth terminal between open and closed conditions. A particular advantage of this type of arrangement is that the power from the given terminal splits between the two control terminals whereby a diode located in one of them never sees more than half the power.

In U.S. Pat. No. 3,559,108 to H. Seidel, coupler switches are disclosed using both the quadrature and 180° type of hybrid junctions. Seidel uses pairs of variable impedances such as a diode for each of the control terminals. Also for modulation, demodulation, phase inversion or switching, the symmetrical arms of a T-junction are conventionally used for control. The nonsymmetrical arms become the signal in and out ports. This is the kind of configuration Seidel uses as is clear from his statement (column 6, lines 72–73), the 180° coupler switch is open in its symmetric state. When using the nonsymmetrical arms for control, as in the present invention, symmetrical impedances in the control arms close the switch. The asymmetry of the nonsymmetrical arms has made it virtually impossible to design control elements in those arms from a strictly theoretical approach. As a result the symmetrical arms have always provided the control function. Using the nonsymmetrical arms for input/output functions raises problems of packaging, particularly in waveguide.

For the most compact insertion of a switch in many waveguide systems, the input/output ports are preferably colinear. The symmetrical arms of a hybrid T-junction are readily colinear while the nonsymmetrical arms are not.

U.S. Pat. No. 3,931,599 to the present inventor discloses a phase invertor using asymmetrical switching in the main arms to produce phase inversion. As with Seidel, variable impedances are provided at both control terminals.

SUMMARY OF THE INVENTION

In accordance with the invention, a hybrid T-junction is provided using a variable impedance in a first branch arm for switching a path through the main arms between open and closed conditions. The second branch arm is shorted at an electrical distance from the input terminal that either provides the closed condition or the open condition over the broadest frequency range with the variable impedance in its highest impedance condition. For the former a low impedance state of the variable impedance opens the switch. For the latter a low state of the variable impedance closes the switch. The first branch arm may be a pseudo H-plane arm in the form of a coaxial stub in which the variable impedance is coaxially positioned.

Thus it is an object of the invention to provide a microwave hybrid junction in which switching is performed by a variable impedance in a first branch arm with a fixed electrical short in the second branch arm.

Further objects and features of the invention will become apparent upon reading the following description together with the drawing.

DESCRIPTION OF THE PREFERRED EMBODIMENT:

A microwave hybrid T-junction, popularly called a Magic Tee, is a four terminal pair coupler having two symmetrical arms herein called "main arms" and two nonsymmetrical arms herein called "branch arms". In waveguide, one of the branch arms is an E-plane (series) arm and the other is an H-plane (shunt) arm.

Figure 1:
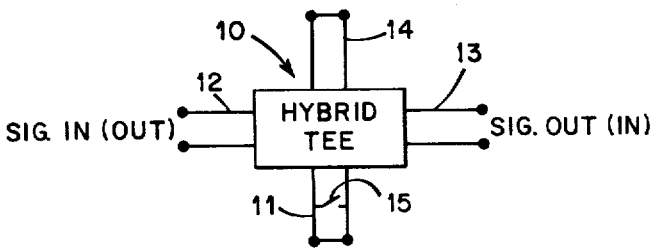
FIG. 1 is a diagrammatic illustration of a generalized embodiment of the invention.

A generalized embodiment of the invention is depicted diagrammatically in FIG. 1 with the main arms of magic tee 10 represented by arms 12 and 13, the E-plane arm represented by shorted arm 14 and the H-plane arm depicted by shorted arm 11 with switch 15 arranged so as to change the electrical length of terminal pair 11 by one quarter wavelength at the design frequency.

Figure 4:
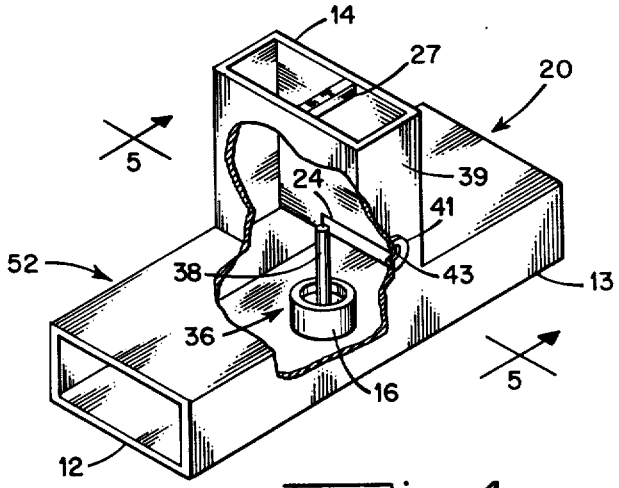
FIG. 4 is an isometric drawing of a device according to FIG. 2.
Figure 2:
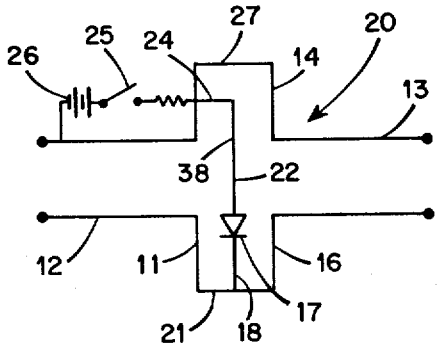
FIG. 2 is a schematic representation of one embodiment of the invention.
Figure 5:
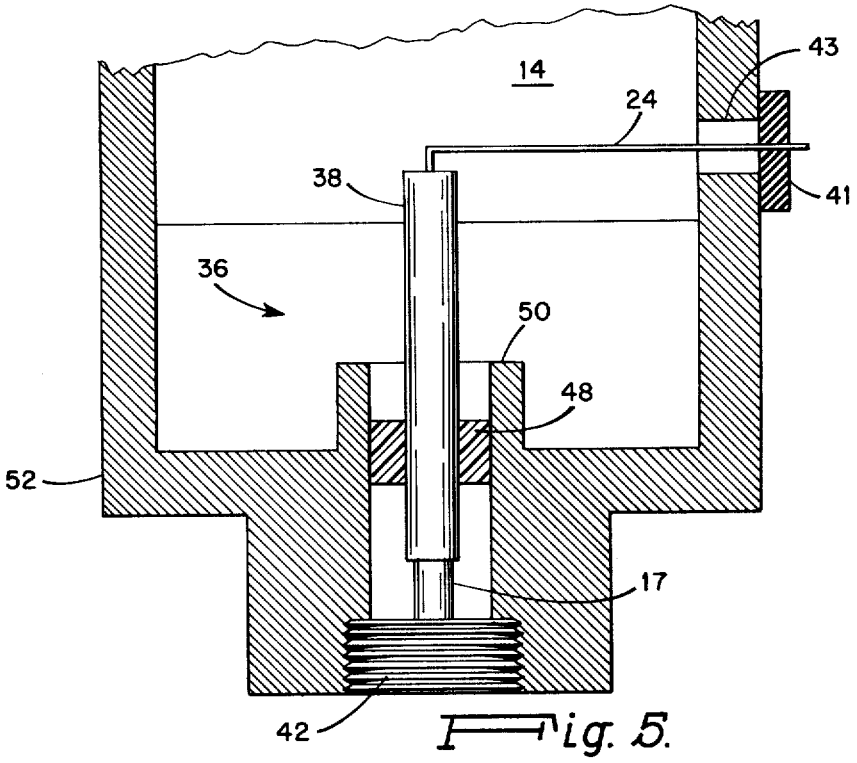
FIG. 5 is an enlarged detail of a cross-section through 5—5 of FIG. 4.
Figure 6B:
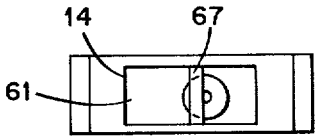
FIG. 6*b* is a top plan view of the device of FIG. 6*a*.
Figure 6C:
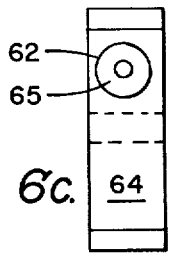
FIG. 6*c* is a left side elevation of the device of FIG. 6*a*.
Figure 6A:
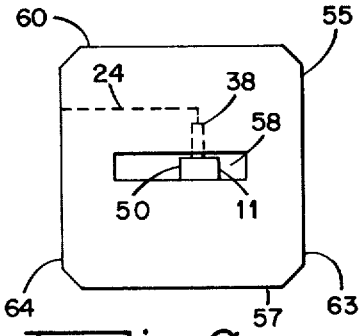
FIG. 6*a* is a front elevation of a second device according to FIG. 2.
Figure 6D:
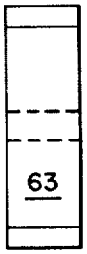
FIG. 6*d* is a right side elevation of the device of FIG. 6*a*.
Figure 6E:
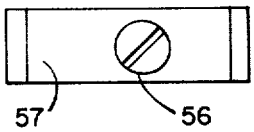
FIG. 6*e* is a bottom plan view of the device of FIG. 6*a*.

One preferred embodiment is depicted electrically in FIG. 2 and mechanically by FIGS. 4 and 5. In each of the figures, the same designation numbers are used for the respective arms of the coupler despite differences in the embodiments.

In FIGS. 2–6, arm 11 is a pseudo H-plane arm. Magic Tee coupler 20 is made of waveguide as depicted in FIG. 4 with shorted coax-to-waveguide transition 16 serving as the pseudo H-plane arm. Transition 16 is positioned in the broad wall of coupler 20 facing the central axis of E-plane arm 14. PIN diode 17 (FIGS. 2 and 5) substitutes for the central conductor of the coax and has first electrode 18 connected to end 21 of transition 16. Second electrode 22 of diode 17 is connected to probe 38 which extends into E-plane arm 14. Lead 24 connects probe 38 through a narrow wall of arm 14 to switch 25. Switch 25 selectively connects direct current source 26 across diode 17 to bias it into a conductive condition. It will be understood that switch 25 may also be a two pole switch and a second direct current source of opposite polarity may be connected to the other pole for reverse biasing diode 17. This is sometimes desirable or even necessary depending, for example, on the characteristics of diode 17 and the energy being propagated.

In coupler 20 arm 14 is terminated with short circuit 27 that is a distance from the center of junction 20 that matches the characteristics of transition 16 so as to provide maximum reflection to arm 12 of energy introduced at arm 12 over the greatest bandwidth about the design frequency with switch 25 open. In this condition, energy at the design frequency introduced at arm 12 splits evenly between the branch arms 11 and 14 and is totally reflected in phase toward arm 12 and antiphase toward arm 13. Thus there is no output at arm 13. Closing switch 25 changes the phase of wave energy reflected in arm 11 by 180°. As conventional in the art, minor adjustments of the structure of transition 16 will commonly be required to obtain accurate 180° switching in any given prototype. Energy at the design frequency now introduced at arm 12 splits evenly between the branch arms 11 and 14 and is totally reflected in phase toward arm 13, thus adding to propagate out arm 13.

Figure 3:
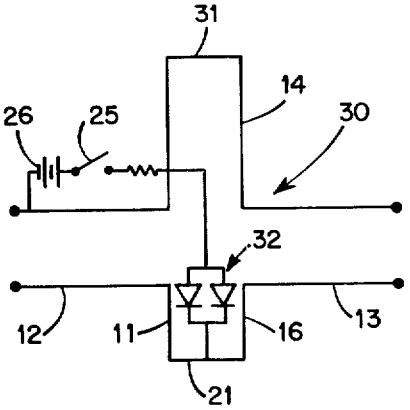
FIG. 3 is a schematic representation of a second embodiment of the invention.

A variation is depicted in FIG. 3. FIG. 3, arm 14, is electrically short circuited by short 31 a distance from the center of junction 30 that matches the characteristics of transition 16 so as to provide maximum transfer of energy from arm 12 to arm 13 over the greatest bandwidth about the design frequency with switch 25 open. Diode 17 is replaced by two diodes 32 in arm 11. The use of two diodes permits doubling the power since the energy will normally divide evenly between the two diodes. The diodes must either be matched or biased through separate impedances to prevent one diode from "hogging" the bias current. A large number of diodes may be used for increasing the power handling ability further. In the configuration of FIG. 3 energy at the design frequency introduced at arm 12 will be reflected from the branch arms in phase toward arm 13 when switch 25 is open. Conversely, closing switch 25 will cause the energy to cancel toward arm 13 providing no output at arm 13. It will be seen that by changing the length of arm 14 energy can be made to pass through with a forward bias of the diodes or it can be blocked with a forward bias of the diodes. The choice in any given situation can be determined to provide minimum stress on the diodes or preferential band characteristics. It has been found that the band characteristics can usually be balanced so as to be almost identical for both conditions of diode biasing, but this is not always the most desirable. The diodes, in some systems are more likely to break down in their forward condition while in other systems they break down more readily in their reverse condition. The inventive junction can be selected to favor the less reliable condition of the diodes for the particular system.

While the pseudo H-arm arrangement has been found to work particularly well, the same basic principles apply to arrangements using a conventional H-arm with a conventional waveguide to coax transition in either the H-plane or E-plane arms. Whichever arm contains the transition, the other arm is shorted or opened in the manner described above.

FIG. 4 depicts an actual device following the schematic of FIG. 2 but omitting switch 25 and current source 26. The device of FIG. 4 is identical to that of the basic magic tee waveguide coupler with the exception that the usual H-plane arm has been replaced by waveguide to coax transition 36 acting as a pseudo H-arm plane arm. E-plane arm 14 is effectively short circuited at its open end by metal strip 27 connected between its broad walls midway between the two narrow walls. Waveguide to coax transition 36 terminates inside the coupler with probe 38 designed in a conventional manner for a waveguide to coax transition. Performance has been found best with probe 38 extending slightly into branch arm 14. Lead 24 from probe 38 is taken out through narrow wall 39 of arm 14 through choke/insulator 41 inserted in wall aperture 43.

Since it is difficult to calculate the exact electrical length of a shorted waveguide to coax transition at a specific design frequency, a model with adjustable parameters is best used as a prototype for any specific embodiment in accordance with the invention. An easy variable for the prototype is a telescoping arm 14 or a short 27 that may be moved along the arm axis. A first approximation can be made with the short at or near the opening into branch arm 14 from main arms 12 and 13. This is so because transition 36 has little electrical length in the configuration of FIG. 4.

FIG. 5 is a cross-section through the center of FIG. 4 detailing waveguide to coax transition 36. Diode 17 is a tiny element held in place by screw cap 42 threaded into body 52 of coupler 20 underneath transition 36. The other end of diode 17 is supported by polytetrafluoroethylene washer 48. Washer 48 is supported in coupler body 52 by metal cylinder 50 extending into the waveguide cavity. Metal probe 38 extends across the main arm cavity into E-arm 14. When using more than one diode, identical transitions can be lined up side by side transversely to the main arm axis. Also a plurality of diodes may be installed in the same transition since the diode elements themselves are quite tiny.

One of the advantages of the inventive coupler is that it can be conveniently adapted to various compact configurations. FIG. *6a–6e* depict a configuration in which the length of the main arms is diminished to virtually nothing while E-arm 14 and pseudo H-arm 11 are both incorporated in a flat metal slab. The components coupled to the main arm ports then become, in effect, the main arms. Aperture 56 was drilled through first edge 57 located centrally relative to the thickness of plate 55. Rectangular aperture 58 matching the cross-section dimensions of a desired waveguide is machined through plate 55 intersecting aperture 56. Second edge 60 is the edge opposite edge 57 while third and fourth edges 63 and 64 are the edges transverse to edges 57 and 60. Aperture 58 is located in the center of the width dimensions of plate 55 between edges 63 and 64. Second rectangular aperture 61, also matching the dimensions of desired waveguide, is machined from top edge 60 to intersect with apertures 56 and 58. Second hole 62 is drilled in from side 64 above the plane of aperture 58 and intersecting with aperture 61. Hole 56 is threaded and a waveguide to coax transition as depicted in FIG. 5 is inserted. Cylindrical support 50 enters into the aperture 58 a short distance. Probe 38 extends further entering into aperture 61. Lead 24 connected to probe 38 passes through teflon plug 65 fitted into hole 62. Shorting bar 67 is positioned across the narrow dimension of aperture 61 to serve as a short.

The inventive concept is readily adapted to a number of configurations varying from those described but coming within the inventive concept. In all of these particular advantage is derived from the fact that the variable impedance used to switch the coupler, switches all the power while handling only half the power. The variable impedance may be a simple conductive pin in the position of the diodes disclosed and operated by a solenoid to provide the same function as the diodes described.

While the embodiments depicted include a showing of variable impedance elements (diodes) in parallel, they can also be used in series to withstand higher potential levels. It is of particular significance that the invention provides junction structures with no limitation on the length of the main arms other than imposed by the thickness of the metal from which the junction is constructed. This gives a great latitude in selection of packaging configurations.

It should also be recognized that, although the described embodiments use mechanical shorts in one of the branch arms, the same effect can be obtained by terminating the arm with a waveguide to coax transition. Such a transition allows the use of a mechanical open which reflects an electrical short a distance away. In this way an open termination may be used in place of a short.

Accordingly, it is intended to cover the invention as set forth in the appended claims.

I claim:

1. A microwave hybrid T-junction in which energy introduced at one of the main arms is blocked or passed to the other main arm by changing the state of a variable impedance in one of the branch arms comprising:

(a) a waveguide body having a first main arm, a second main arm, a first branch arm and a second branch arm, one said branch arm being an E-plane arm and the other being an H-plane arm;

(b) a variable impedance located in said first branch arm variable between a high impedance state and a low impedance state by application of an electrical control signal, said variable impedance arranged so as to change the phase of wave energy reflected in said first branch arm at the design frequency by 180 degrees when said variable impedance changes impedance states;

(c) a short circuit of conductive material across said second branch arm at a location providing a maximum energy transfer condition between the first and second main arms at a design frequency bandwidth for one condition of said variable impedance.

2. A microwave hybrid T-junction according to claim 1 wherein said variable impedance is a diode mounted in a waveguide to coaxial line transition structure.

3. A microwave hyrid T-junction according to claim 1 wherein said first branch arm is a pseudo H-plane arm in the form of a waveguide to coaxial line transition element and said variable impedance is a diode mounted coaxially within said element.

4. A microwave hybrid T-junction according to claim 3 wherein said diode has a first electrode connected to a short circuited end of said element and a second electrode connected to a probe extending partially into said second branch arm.

5. A microwave hybrid T-junction according to claim 4 further comprising an electrical control signal source, a first connection from said source through a wall of said second branch arm to said probe and a second connection from said source to the body of said coupler so as to form a circuit with said diode.

6. A microwave hybrid T-junction according to claim 3 wherein said waveguide body is made in the form of a flat metal plate incorporating said first branch arm and said second branch arm within the periphery of the plate.

7. A microwave hybrid T-junction according to claim 1 wherein said variable impedance comprises at least two variable impedance elements.

8. A microwave hybrid T-junction according to claim 1 wherein the length of the main arms is substantially the thickness of the metal from which the junction is constructed.

* * * * *